US009169734B2

(12) United States Patent
Woehler

(10) Patent No.: US 9,169,734 B2
(45) Date of Patent: Oct. 27, 2015

(54) SYSTEM FOR SPECIFYING AN INSTALLATION POSITION OF ROTOR BLADES, SECURING ELEMENT, ROTOR BLADE, TURBOMACHINE, AND METHOD

(71) Applicant: MTU AERO ENGINES GMBH, Munich (DE)

(72) Inventor: Marcus Woehler, Puchheim (DE)

(73) Assignee: MTU Aero Engines AG, Munich (DE)

( * ) Notice: Subject to any disclaimer, the term of this patent is extended or adjusted under 35 U.S.C. 154(b) by 570 days.

(21) Appl. No.: 13/775,115

(22) Filed: Feb. 22, 2013

(65) Prior Publication Data

US 2014/0241893 A1 Aug. 28, 2014

(51) Int. Cl.
*B64C 11/04* (2006.01)
*F01D 5/32* (2006.01)
*F01D 5/30* (2006.01)

(52) U.S. Cl.
CPC . *F01D 5/323* (2013.01); *F01D 5/30* (2013.01); *Y10T 29/49321* (2015.01)

(58) Field of Classification Search
CPC ..... F01D 5/30; F01D 5/323; Y10T 29/49321
USPC ..... 416/219 R, 220 R; 29/889.21, 889.23
See application file for complete search history.

(56) References Cited

U.S. PATENT DOCUMENTS 3,076,634 A 2/1963 Boyle et al.
8,167,566 B2 * 5/2012 Howes ..... 416/219 R

FOREIGN PATENT DOCUMENTS

CH 360073 A 2/1962

* cited by examiner

*Primary Examiner* — Ching Chang
(74) *Attorney, Agent, or Firm* — Howison & Arnott, LLP

(57) ABSTRACT

A system for specifying an installation position of adjacent rotor blades of a blade row of a turbomachine is disclosed. The system has a plurality of axial securing elements, which have at least two sections with different profile areas for the arrangement in each case between a groove base of a rotor shaft and a blade root, which are joined together by a connecting web at a groove distance from one another, and which have counter-contours on the blade root side for forming in each case a positive-fit pair with the profile areas. Also disclosed are a securing element and a rotor blade for this type of system, a turbomachine having a rotor which has this type of system, and a method for manufacturing this type of rotor.

18 Claims, 2 Drawing Sheets

SYSTEM FOR SPECIFYING AN INSTALLATION POSITION OF ROTOR BLADES, SECURING ELEMENT, ROTOR BLADE, TURBOMACHINE, AND METHOD

TECHNICAL FIELD

The invention relates to a system for specifying an installation position of adjacent rotor blades of a blade row of a turbomachine, a securing element for this type of system, a rotor blade for this type of system, a turbomachine, and a method for manufacturing a rotor.

BACKGROUND

In high-speed turbomachines such as aircraft engines, attention must always be paid to vibration excitation of the rotor system. The vibration excitation occurs due to fluid-structure interaction, which under certain operating conditions may result in resonances which may endanger the structural-mechanical integrity of a rotor blading system. To minimize excitation mechanisms of the rotor system, adjacent rotor blades of an installed rotor assembly may be detuned as the result of different blade geometries. Since an incorrect positioning of the different blade profiles with respect to one another may result in disadvantageous vibration excitation of the rotor system, and thus to destruction of the rotor system, frequency detuning also requires a specific, in particular alternating, arrangement of the rotor blades with respect to one another. Although known elements, such as those disclosed in the publications CH 360 073 A and U.S. Pat. No. 3,076,634 A, for positioning rotor blades on rotor hubs allow axial securing of the rotor blades in rotor grooves, they do not prevent incorrect positioning of adjacent rotor blades with respect to one another, so that known elements do not ensure the safety-relevant function of the alternating arrangements in frequency detuning.

SUMMARY AND DESCRIPTION

An object of the invention is to provide a system for specifying an installation position of adjacent rotor blades of a blade row of a turbomachine which allows simple installation of rotor blades for frequency detuning A further object of the invention is to provide a securing element and a rotor blade for this type of system, a turbomachine with very smooth running, and a method for manufacturing a rotor for this type of turbomachine.

This object is achieved by a system having the features as described and claimed herein, by a securing element having the features as described and claimed herein, by a rotor blade having the features as described and claimed herein, by a turbomachine having the features as described and claimed herein, and by a method having the features as described and claimed herein.

A system according to the invention for specifying an installation position of adjacent rotor blades of a blade row of a turbomachine has a plurality of axial securing elements which have at least two sections with different profile areas for the arrangement in each case between a groove base of a rotor shaft and a blade root, which are joined together by a connecting web at a groove distance from one another. In addition, the system has counter-contours on the blade root side for forming in each case a positive-fit pair with the profile areas.

As a result of the system according to the invention, rotor blades having different blade profiles may be quickly and reliably installed in the correct position with respect to one another on a rotor shaft. Each of the profile areas allows the positioning of only one counter-contour, so that when the counter-contours are appropriately associated with the rotor blades, an alternating arrangement of the respective different blade profiles is automatically maintained. Due to the positive fit of the different profile areas with the counter-contours, the alternating arrangement is ensured without errors. The system according to the invention thus provides an effective approach to ensuring the safety-relevant function of the frequency detuning in the design of bladed rotors. In addition, the positive fit between the profile areas on the securing element side and the counter-contours on the blade side results in a mechanical coupling of the respective adjacent rotor blades, which brings about vibration damping. As a result of connecting the sections at a groove distance from one another, the securing elements may be easily positioned in the rotor grooves. In addition, due to the integration of the profile areas into the axial securing elements, no additional elements for axially securing the rotor blades are necessary.

For axially securing the rotor blades, the sections may have widened locking sections which are radially outwardly bendable against an end face of the blade roots and an axial face of the rotor shaft.

For reducing the weight of the securing elements, the particular connecting web may be tapered with respect to the sections. In addition, to improve the axial securing of the rotor blades, the connecting web may be radially outwardly bendable against an end face of the blade roots.

The profile areas and counter-contours are easily manufacturable when the profile areas are configured as elevations and the counter-contours are configured as longitudinal indentations. To avoid sharp-edged contours, the elevations preferably have a circular cross-sectional surface area or a cup-like or conical lateral surface area, but in principle may also be configured as pyramids, webs, or the like with some other type of cross-sectional surface area.

The manufacture of the profile areas may be further simplified if the elevations are plastic deformations of the sections and are situated next to one another in the transverse direction. As a result of the plastic deformations, the securing elements may have a one-piece or one-part design. Due to the arrangement of the sections next to one another in the transverse direction, the longitudinal indentations may be continuously introduced into the blade roots in the axial direction, and do not have to have a specific length.

The system may have a single-acting installation control, such that the at least two positive-fit pairs have different widths b1, b2.

However, the system may also have a single-acting installation control, such that the at least two positive-fit pairs have different heights h1, h2.

However, to reliably ensure a correct association of the rotor blades in the event of unexpectedly large component tolerances, it may be advantageous for the system to have a double-acting installation control, and for this purpose, for example for the wide positive-fit pairs to be flatter than the narrow positive-fit pairs.

A securing element according to the invention for a system according to the invention has at least two sections for the arrangement in each case between a groove base and a blade root, which have different profile areas and are joined together by a connecting web at a groove distance from one another. This type of securing element is easily manufactured, for example by means of a punching process, from a metal sheet having precisely formed profile areas.

A rotor blade according to the invention for a system according to the invention has a counter-contour for positive-fit cooperation in each case with a profile area of an axial securing element. The counter-contour is easily and precisely insertable into the rotor blade in the manufacturing process, and allows an exact association of the rotor blade with the rotor grooves fitted with the securing elements.

A turbomachine according to the invention has a rotor which is provided with a system according to the invention. This type of turbomachine is characterized by quick rotor installation and very smooth running, since rotor blades having different blade profiles of a blade row for the frequency detuning may be situated next to one another without errors. In addition, as a result of the rotor blades being mechanically coupled to one another at least in pairs due to the securing elements and due to the positive-fit pairs, which damps vibrations, this has a positive effect on smooth running.

The smooth running may be further improved when the securing elements act as balancing weights. Due to their arrangement in the rotor grooves, the securing elements are situated near the rotational axis, thus achieving a high balancing effect with only small masses.

In a method according to the invention for manufacturing a rotor, prior to installation of a rotor blade, axial securing elements are positioned with their sections in rotor grooves, and rotor blades are then associated with the rotor grooves based on their counter-contours which cooperate in a positive-fit manner with profile areas of the securing elements on the section side. The securing elements may be positioned in the rotor grooves much more easily than the rotor blades, so that as a result of the method according to the invention, incorrect positioning may be recognized early when the rotor blades are inserted into the rotor grooves. Due to the at least two sections, it is possible for securing elements having the same design to be arbitrarily arranged next to one another. A particular arrangement of the securing elements next to one another is not necessary.

Other advantageous exemplary embodiments of the invention are the subject matter of further subclaims.

BRIEF DESCRIPTION OF THE DRAWINGS

Preferred exemplary embodiments of the invention are explained in greater detail below with reference to greatly simplified schematic illustrations, which show the following.

DETAILED DESCRIPTION

Figure 1:
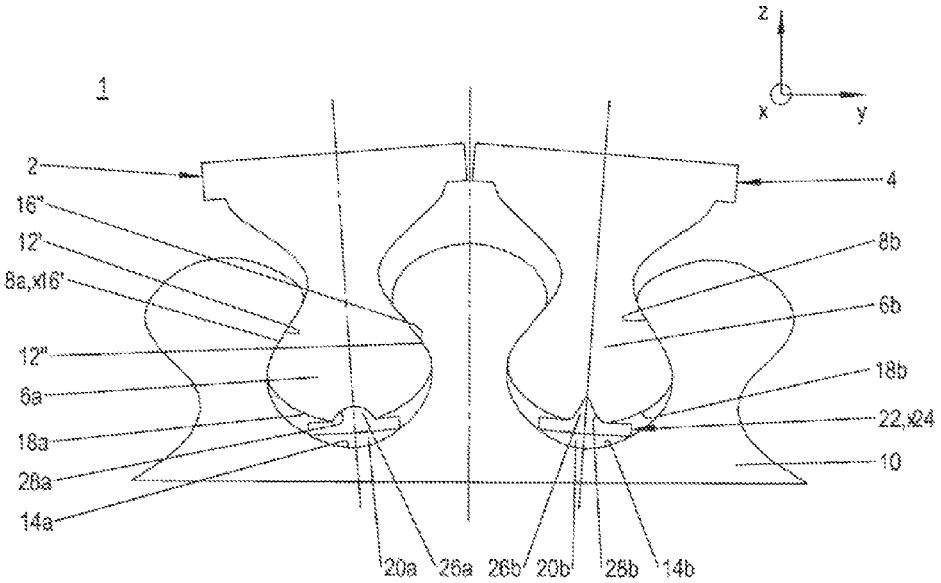
FIG. 1 shows a front view of a detail of a rotor of a turbomachine in the area of a rotor blade row.

FIG. 1 shows a detail of a rotor 1 of a turbomachine in the area of a rotor blade row. The turbomachine is in particular an aircraft engine, and the rotor blade row is situated in the turbine area, for example. Of course, the rotor blade row may also be positioned on the compressor side, for example in the low-pressure compressor. The rotor blade row has a plurality of rotor blades 2, 4 which are adjacent to one another in the peripheral direction, and which with their blade roots 6*a*, 6*b*, respectively, are inserted into a respective rotor groove 8*a*, 8*b* of a rotor shaft 10.

The rotor grooves 8*a*, 8*b* have identical cross sections. As is apparent from the numbering of the left rotor groove 8*a* according to the view in FIG. 1, the rotor grooves 8*a*, 8*b* in each case have two oppositely situated lateral groove faces 12', 12" which are joined together via a radial inner groove base 14*a*, 14*b*, respectively, and are oriented so as to radially outwardly converge toward one another.

In principle, the blade roots 6*a*, 6*b* have a cross section which corresponds to the cross section of the rotor grooves 8*a*, 8*b*, respectively. As illustrated by the numbering of the left blade root 6*a*, the blade roots 6*a*, 6*b* in each case have two oppositely situated lateral faces 16', 16" which are oriented so as to radially inwardly diverge from one another and cooperate with the lateral groove faces 12', 12", respectively, in a positive-fit manner. In addition, the blade roots 6*a*, 6*b* have a base face 18*a*, 18*b*, respectively, which joins the respective lateral faces 16', 16" together. In the installed, i.e., inserted, state of the rotor blades 2, 4, a cavity 20*a*, 20*b*, respectively, extending in a sickle shape in the longitudinal direction x is formed between the respective groove bases 14*a*, 14*b* and base faces 18*a*, 18*b*.

To achieve frequency detuning, the rotor blades 2, 4 have different blade profiles. A system 22 for specifying an installation position of the adjacent rotor blades 2, 4 and in particular an alternating arrangement of the rotor blades 2, 4 is provided for the alternating arrangement of the respective different blade profiles. The system 22 has a plurality of axial securing elements 24, having at least two different profile areas 26*a*, 26*b* and having a plurality of counter-contours 28*a*, 28*b*, respectively, on the blade side for cooperating with one of the profile areas 26*a*, 26*b*, respectively, in a positive-fit manner. The securing elements 24 are multifunctional, and in addition to specifying an installation position of the rotor blades 2 are also used for axially securing the rotor blades 2, 4 in the rotor grooves 8*a*, 8*b*, respectively, and optionally as balancing weights for balancing the rotor 1.

Figure 2:
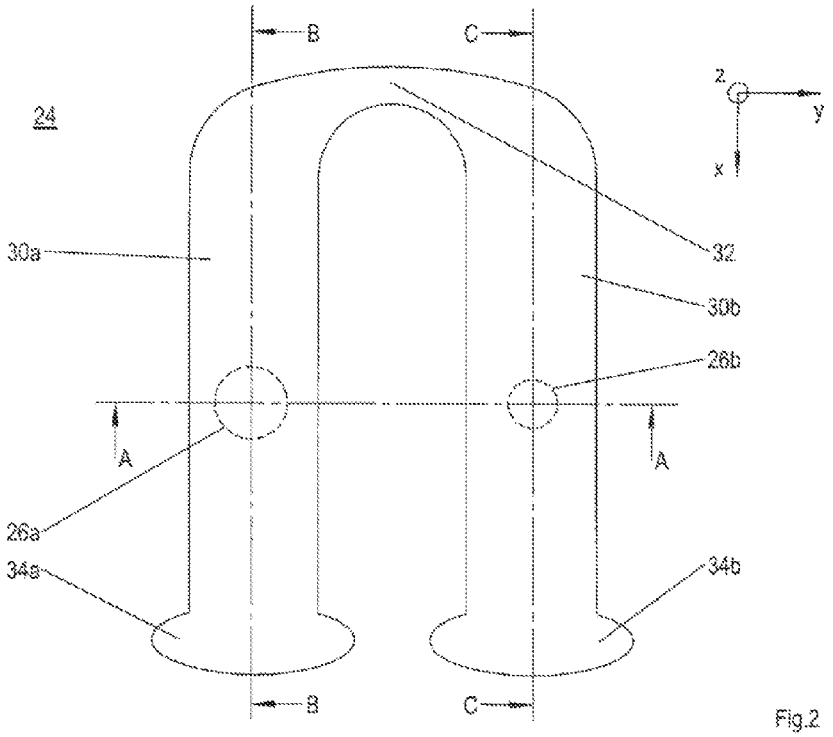
FIG. 2 shows a top view of an axial securing element according to the invention.

As is apparent in the top view in FIG. 2, the securing elements 24 are U-shaped. The securing elements have a one-part design, and are made of a high temperature-resistant metal. In particular, the securing elements are punched or cut from a flat metal sheet. The securing elements in each case have two sections 30*a*, 30*b*, extending parallel in the longitudinal direction x, for arranging in the cavities 20*a*, 20*b*, respectively, and in each case have a connecting web 32 which joins the sections 30*a*, 30*b* together.

In principle, however, more than two sections 30*a*, 30*b* per securing element 24 are also possible. For example, three or four sections 30*a*, 30*b* may be provided, in which case, however, bending of the securing elements 24 in the peripheral direction is preferred for forming a rotor radius.

In addition, the securing elements 24 in each case have two locking sections 34*a*, 34*b*. The locking sections 34*a*, 34*b* are joined to the sections 30*a*, 30*b*, respectively, at a distance from the connecting web 32, and are widened with respect to these sections.

The profile areas 26*a*, 26*b* are preferably centrally situated on the sections 30*a*, 30*b*, respectively, in the longitudinal direction x and in the transverse direction y. The profile areas are formed as integral elevations of the sections 30*a*, 30*b*, and according to the illustration in FIG. 2 are preferably plastic deformations which extend in the vertical direction z.

Figure 3:
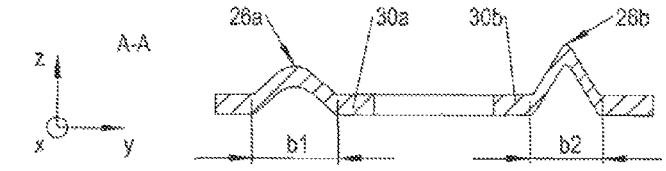
FIG. 3 shows a cross section of the securing element.
Figure 4:
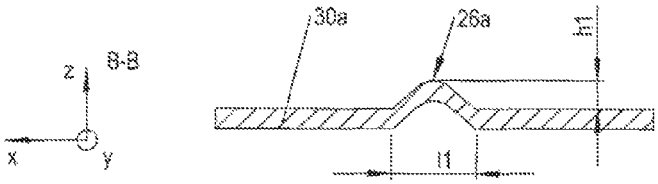
FIG. 4 shows a first longitudinal section of the securing element.

As shown in the cross section along the line A-A in FIG. 3 and in the longitudinal section along the line B-B in FIG. 4, the elevation 26*a* of the left section 30*a* has a width b1, a length l1, and a height h1. The width b1 is equal to the length l1, so that the elevation 26*a* has a protuberant or cup-like shape.

Figure 5:
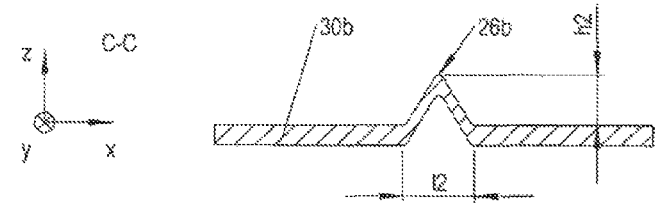
FIG. 5 shows a second longitudinal section of the securing element.

As shown in the cross section along the line A-A in FIG. 3 and in the longitudinal section along the line C-C in FIG. 5, the right elevation 26*b* has a width b2, a length l2, and a height h2. The width b2 is equal to the length l2, but the height h2 is significantly greater than the width b2 and the length l2, so that in principle the right elevation 26*b* has a spiked or conical shape.

Figure 6:
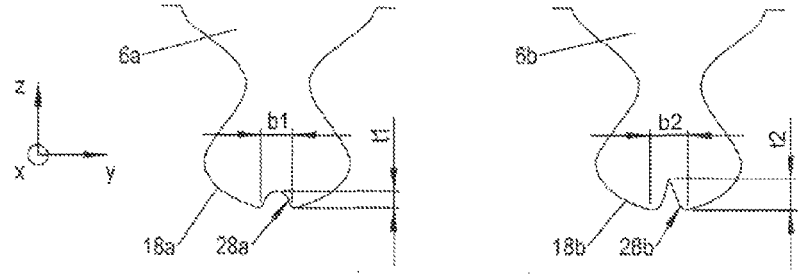
FIG. 6 shows a front view of counter-contours according to the invention.

As shown in FIG. 6, the counter-contours 28*a*, 28*b* are configured as longitudinal indentations which are introduced into the respective base faces 18*a*, 18*b* of the blade roots 6*a*, 6*b*, and which pass through same in the longitudinal direction x for simplified installation. The counter-contours in each case form a positive-fit pair with the profile areas 26*a*, 26*b*, and for this purpose have corresponding complementary geometric dimensions. Thus, the longitudinal indentations 28*a*, 28*b* in each case have a width that is equal to the widths b1, b2 of the profile areas 26*a*, 26*b*, respectively. In addition, the left longitudinal indentation 28*a* has a depth t1 that is equal to the height h1 of the elevation 26*a*. The right longitudinal indentation 28*b* correspondingly has a depth t2 that is equal to the height h2 of the elevation 26*b*.

Preferred values for dimensioning of the positive-fit pairs 26*a*, 28*a* and 26*b*, 28*b* are the widths b1, b2 and the heights h1, h2 or t1, t2; in particular, the relationships b1>b2 and h1<h2 or t1<t2 apply for forming a double-acting installation control. On the basis of these geometric relationships, the wide positive-fit pairs 26*a*, 28*a* are flatter than the narrow positive-fit pairs 26*b*, 28*b*, and the narrow positive-fit pairs 26*b*, 28*b* are higher than the wide positive-fit pairs 26*a*, 28*a*. The lengths l1, l2 are particularly important when the longitudinal indentations 28*a*, 28*b* are not continuous, but instead have an extension in the longitudinal direction x which corresponds to a longitudinal distance of the profile areas 26*a*, 26*b* from the locking sections 34*a*, 34*b*.

Figure 7:
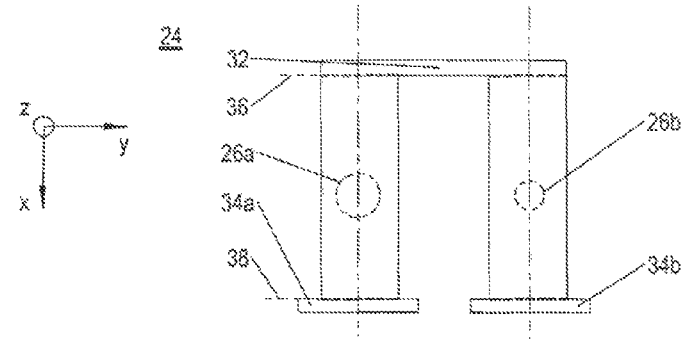
FIG. 7 shows a top view of the securing element in the installed state.
Figure 8:
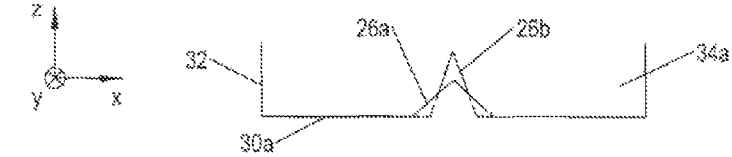
FIG. 8 shows a side view of the securing element in the installed state.

As shown in FIGS. 7 and 8, the particular connecting web 32 and the locking sections 34*a*, 34*b* are respectively bendable in the direction of the elevations 26*a*, 26*b* about a bending axis 36, 38 which extends in the transverse direction y. As a result, after installation of the rotor blades 2, 4, the particular connecting web 32 and the locking sections 34*a*, 34*b* of the securing elements make contact with oppositely situated end faces of the blade roots 6*a*, 6*b* and with oppositely situated axial faces of the rotor shaft, in both cases in a positive-fit manner, resulting in axial securing of the rotor blades 2, 4 to the rotor shaft 10.

In a method according to the invention for manufacturing a rotor 1, prior to installation of the rotor blades 2, 4, the axial securing elements 24 are positioned with their sections 30*a*, 30*b* in the rotor grooves 8*a*, 8*b*, respectively, in such a way that the respective profile areas 26*a*, 26*b* point radially outwardly. If the securing elements 24 are also to act as balancing weights, consideration is made for arranging the securing elements 24 next to one another according to their masses. In the orientation of the securing elements 24 in the longitudinal direction x, it is possible in principle to arrange the securing elements in such a way that their locking sections 34*a*, 34*b* form a downstream area. Likewise, the connecting webs 32 may form the downstream area. However, the orientation of the securing elements 24 in the longitudinal direction x should not be changed in a rotor blade row.

After the securing elements 24 are positioned in the rotor grooves 8*a*, 8*b*, the rotor blades 2, 4 are inserted into the rotor grooves 8*a*, 8*b*, respectively, in such a way that that a respective positive-fit connection is formed between a profile area 26*a*, 26*b* and a counter-contour 28*a*, 28*b*. After the rotor blades 2, 4 have been inserted into the rotor grooves 8*a*, 8*b*, respectively, and thus, after the different blade profiles have been alternatingly positioned, the connecting webs 32 and the locking sections 34*a*, 34*b* for axially securing the rotor blades 2, 4 in the rotor grooves 8*a*, 8*b*, respectively, are bent radially outwardly about the bending axes 36, 38 and brought into contact with the oppositely situated end faces of the blade roots 6*a*, 6*b* and with the oppositely situated axial faces of the rotor shaft 10.

A system for specifying an installation position of adjacent rotor blades of a blade row of a turbomachine is disclosed, having a plurality of axial securing elements which have at least two sections with different profile areas for the arrangement in each case between a groove base of a rotor shaft and a blade root, which are joined together by a connecting web at a groove distance from one another, and which have counter-contours on the blade root side for forming in each case a positive-fit pair with the profile areas; also disclosed are a securing element and a rotor blade for this type of system, a turbomachine having a rotor which has this type of system, and a method for manufacturing this type of rotor.

LIST OR REFERENCE NUMERALS

1 Rotor
2 Rotor blade
4 Rotor blade
6*a, b* Blade root
8*a, b* Rotor groove
10 Rotor shaft
12', 12" Lateral groove face
14 Groove base
16', 16" Lateral face
18*a, b* Base face
20*a, b* Cavity
22 System
24 Securing element
26*a, b* Profile area
28*a, b* Counter-contour
30*a, b* Section
32 Connecting web
34*a, b* Locking section
36 Bending axis
38 Bending axis
b1, b2 Width
l1, l2 Length
h1, h2 Height
t1, t2 Depth
x Longitudinal direction
y Transverse direction
z Vertical direction

The invention claimed is:

1. A system for specifying an installation position of adjacent rotor blades of a blade row of a turbomachine, the turbomachine including a rotor shaft having a plurality of adjacent rotor grooves with identical cross sections spaced apart at a groove distance, the system comprising:

a plurality of rotor blades of a first type, each rotor blade of the first type having a blade root positionable in one of the rotor grooves and having a counter contour of a first type formed in a base face of the blade root such that, when the blade root is positioned in one of the rotor grooves, the counter contour of the first type faces a groove base of the rotor groove;

a plurality of rotor blades of a second type, each rotor blade of the second type having a blade root positionable in one of the rotor grooves and having a counter contour of a second type formed in a base face of the blade root such that, when the blade root is positioned in one of the rotor shaft grooves, the counter contour of the second type faces the groove base of the rotor groove; and a plurality of axial securing elements, each securing element having at least a first section and a second section spaced apart a groove distance from one another and joined together by a connecting web;

the first section including a profile area of a first type that is configured to form a positive-fit pair with the counter contour of the first type when positioned between the groove base of a rotor groove and the blade root of a rotor blade of the first type;

the second section including a profile area of a second type that is configured to form a positive-fit pair with the counter contour of the second type when positioned between the groove base of a rotor groove and the blade root of a rotor blade of the second type;

whereby each axial securing element is positionble with the first section in a first rotor groove of the rotor shaft and the second section in an adjacent rotor groove such that the profile area of the first type on the first section permits the positioning of a rotor blade of the first type in the first rotor groove but blocks the positioning of a rotor blade of the second type in the first rotor groove and the profile area of the second type on the second section permits the positioning of a rotor blade of the second type in the adjacent rotor groove but blocks the positioning of a rotor blade of the first type in the adjacent rotor groove.

2. A system in accordance with claim 1, wherein the first and second sections have widened locking sections that are radially outwardly bendable against an end face of the blade roots and an axial face of the rotor shaft after positioning a rotor blade in the rotor groove.

3. A system in accordance with claim 1, wherein the width of the connecting web is tapered with respect to the first and second sections, and radially outwardly bendable against an end face of the blade roots after positioning a rotor blade in the rotor groove.

4. A system in accordance with claim 1, wherein the profile areas of the first and second types are elevations and the counter-contours of the first and second types are longitudinal indentations.

5. A system in accordance with claim 4, wherein the elevations are plastic deformations of the first and second sections and are situated next to one another in the transverse direction (y).

6. A system in accordance with claim 1, wherein the type of positive-fit pair formed by the first profile area and first counter contour has at least a different width than the type of positive-fit pair formed by the second profile area and the second counter contour.

7. A system in accordance with claim 6, wherein the one of the types of positive-fit pairs that is wider than the other type of positive-fit pair is not as high as the other type of positive-fit pair.

8. A system in accordance with claim 1, wherein the type of positive-fit pair formed by the first profile area and first counter contour has at least a different height than the type of positive-fit pair formed by the second profile area and the second counter contour.

9. A system in accordance with claim 8, wherein the one of the types of positive-fit pairs that is higher than the other type of positive-fit pair is not as wide as the other type of positive-fit pair.

10. A system in accordance with claim 1, wherein the axial securing elements act as balancing weights for the turbomachine.

11. An axial securing element for specifying an installation position of adjacent rotor blades of a blade row of a turbomachine, the turbomachine including a rotor shaft having a plurality of adjacent rotor grooves with identical cross sections spaced apart at a groove distance, a plurality of rotor blades of a first type and a plurality of rotor blades of a second type, each rotor blade of both the first type and the second type including a blade root with a base face positioned in one of the plurality of rotor grooves with the base face facing a groove base of the rotor groove, the axial securing element comprising:

a first section and a second section spaced apart a groove distance from one another and joined together by a connecting web;

the first section including a profile area of a first type that is configured to form, when positioned in a rotor groove between the groove base and the base face of a blade root, a positive-fit pair with a counter contour of a first type formed in the base faces of the rotor blades of the first type;

the second section including a profile area of a second type that is configured to form, when positioned in a rotor groove between the groove base and the base face of a blade root, a positive-fit pair with a counter contour of a second type formed in the base faces of the rotor blades of the second type; and whereby the axial securing element is positionble with the first section in a first rotor groove of the rotor shaft and the second section in an adjacent rotor groove such that the profile area of the first type on the first section permits the positioning of a rotor blade of the first type in the first rotor groove but blocks the positioning of a rotor blade of the second type in the first rotor groove and the profile area of the second type on the second section permits the positioning of a rotor blade of the second type in the adjacent rotor groove but blocks the positioning of a rotor blade of the first type in the adjacent rotor groove.

12. An axial securing element in accordance with claim 11, wherein the axial securing element has a U-shaped configuration when viewed from the top.

13. An axial securing element in accordance with claim 11, wherein the first and second sections have widened locking sections at their respective free ends.

14. A system in accordance with claim 11, wherein the width of the connecting web is tapered with respect to the first and second sections.

15. A method for manufacturing a rotor for a turbomachine, the turbomachine including a rotor shaft having a plurality of adjacent rotor grooves with identical cross sections spaced apart at a groove distance, a plurality of rotor blades of a first type and a plurality of rotor blades of a second type, each rotor blade of both the first type and the second type including a blade root with a base face positioned in one of the plurality of rotor grooves with the base face facing a groove base of the rotor groove, the method comprising the following steps:

forming a counter contour of a first type in the base face of the blade root of each rotor blade of the first type;

forming a counter contour of a second type in the base face of the blade root of each rotor blade of the second type;

providing a plurality of axial securing elements, each securing element having at least a first section and a second section spaced apart a groove distance from one another and joined together by a connecting web;

the first section including a profile area of a first type that is configured to form a positive-fit pair with the counter contour of the first type when positioned between the groove base of the rotor groove and the blade root of a rotor blade of the first type;

the second section including a profile area of a second type that is configured to form a positive-fit pair with the counter contour of the second type when positioned between the groove base of the rotor groove and the blade root of a rotor blade of the second type;

positioning the plurality of axial securing elements with the first section in a first rotor groove of the rotor shaft and the second section in an adjacent rotor groove;

positioning rotor blades of the first type into the rotor grooves occupied by the first sections to form positive-fit pairs between the profile areas of the first type and the counter contours of rotor blades of the first type; and positioning rotor blades of the second type into the rotor grooves occupied by the second sections to form positive-fit pairs between the profile areas of the second type and the counter contours of rotor blades of the second type.

16. A method in accordance with claim 15, wherein the securing elements are arranged next to one another according to their masses for purposes of balancing the rotor.

17. A method in accordance with claim 15, further comprising the step of bending a free end of one of the first or second sections of the securing element radially outwardly against an end face of the blade roots and an axial face of the rotor shaft after positioning a rotor blade in the rotor groove.

18. A method in accordance with claim 15, further comprising the step of bending the connecting web of the securing element radially outwardly against an end face of the blade roots after positioning a rotor blade in the rotor groove.

* * * * *